US005156172A

United States Patent [19]

Tancredi

[11] Patent Number: 5,156,172

[45] Date of Patent: Oct. 20, 1992

[54] DEVICE AND METHOD FOR COSMETICALLY TREATING HAIR

[75] Inventor: Andrew J. Tancredi, New York, N.Y.

[73] Assignees: Paul Straubinger, Long Island City; David P. Feldman, Roslyn, both of N.Y. ; a part interest to each

[21] Appl. No.: 800,233

[22] Filed: Nov. 29, 1991

[51] Int. Cl.[5] ..... A45D 19/18

[52] U.S. Cl. ..... 132/270; 132/207; 132/208; 132/222

[58] Field of Search ..... 132/207, 208, 212, 222, 132/270

[56] References Cited

U.S. PATENT DOCUMENTS

| | | | |
|---|---|---|---|
| 3,543,771 | 12/1970 | Altman | 132/222 |
| 3,692,032 | 9/1972 | Regas | 132/270 |
| 3,786,819 | 1/1974 | Cantrell | 132/270 |
| 3,800,811 | 4/1974 | Esposto | 132/270 |
| 3,921,647 | 11/1975 | Fisher | 132/270 |
| 3,941,613 | 3/1976 | Nicoletti | 132/270 |
| 4,144,897 | 3/1979 | Mosz | 132/270 |
| 4,398,549 | 8/1983 | Thomas | 132/270 |
| 4,903,715 | 2/1990 | Thomas | 132/270 |

*Primary Examiner*—Gene Mancene
*Assistant Examiner*—Frank A. LaViola
*Attorney, Agent, or Firm*—Kirschstein, Ottinger, Israel & Schiffmiller

[57] ABSTRACT

A fastener of a hair-treating device is first slid into position adjacent a human scalp and, thereupon, is affirmatively locked on a bundle of hair in a non-slip manner. A shield attached to the fastener is opened to receive a different bundle of hair for application of a treating agent, and thereupon closed to prevent the treating agent from seeping to the balance of hair on the scalp. An independently operated bleed-guard further resists treating agent seepage.

21 Claims, 6 Drawing Sheets

8
9
7
100
182
138
146
134
142
174
122
140
136
144
132
172
184
170
112
126
114
116
118
124
180
50
52
70
134
186

DEVICE AND METHOD FOR COSMETICALLY TREATING HAIR

BACKGROUND OF THE INVENTION

1. Field of the Invention

This invention generally relates to a device for and method of cosmetically treating hair and, more particularly, to selectively treating bundles or strands of hair by highlighting and streaking techniques.

2. Description of Related Art

Instead of bleaching an entire head of hair, many people, especially women, periodically have selected strands or bundles of hair treated with a treating agent, e.g. bleach or dye, to provide a color contrast with the balance of the hair on the person's head. This technique is commonly known as frosting or streaking, and many methods and tools have been developed for use by hair dressers, stylists and beauticians for applying this technique to a person's hair.

It is known, for example, to cover a person's head with a closely-fitting rubber cap pierced through with a multitude of holes. An operator inserts a hook into selected holes and pulls out a bundle of hair. The hair thus exposed is then treated with a bleach or dye while the hair underneath the cap, at least in theory, is isolated and untreated.

Although commonplace, this known cap-frosting technique has many disadvantages. The presence of the cap itself makes it difficult to bleach the roots of the hair being treated. The operator cannot see through the cap, making it difficult to control exactly which hair bundle is being treated. It is loose-fitting and, in many cases, actually painful to the person undergoing treatment to have long hairs pulled through the cap holes with the hook. There is the ever-present problem of shifting of the cap on the person's head, as well as the problem of seepage of the bleach or dye back through the holes to discolor strands of hair not desired to be treated.

Another common prior art technique is conventionally known as the "basic foil" method wherein hair to be treated is placed above a rectangular sheet of aluminum foil whose upper edge is held closely against a person's scalp. The treating agent is applied to the hair thus isolated above the foil. The lower end of the foil is then folded or rolled up toward the head. The sides of the foil are thereupon folded inwardly to form a self-clinging, crimped envelope in which the treated hair is enclosed. The foil technique is very messy, labor-intensive, and difficult to perform properly. A great deal of skill is required by the operator. Despite such great skill, seepage of the treating agent can occur, and especially so when the person moves her head or when the foils shift in position or when the operator opens the envelope to check hair color.

In an effort to prevent aluminum foils from shifting, U.S. Pat. No. 4,224,954 teaches the use of clips to temporarily hold the foils in place. However, once the clips are removed, the foils may accidentally shift. U.S. Pat. No. 4,196,741 teaches the use of an adhesive strip on aluminum foil sheets. However, experience has shown that such adhesive strips tend to fail when exposed to the treating agent. U.S. Pat. Nos. 3,786,819; 3,921,647 and 3,452,759 teach hair fasteners that mechanically lock onto the hair being treated. However, the non-compact, bulky nature of such hair fasteners prevents the treating agent from reaching the roots of the hair to be treated, making for an uneven, sloppy appearance.

U.S. Pat. No. 4,144,897 teaches a hinged case which snaps shut over the hair being treated. Here, again, however, it is difficult to prevent seepage of the treating agent out through the upper end of the case adjacent the scalp, as well as to prevent slippage of the case relative to the hair being treated. U.S. Pat. No. 4,298,104 discloses a cylinder or tube that fits over a person's entire head and is analogous to the cap-frosting technique described above.

SUMMARY OF THE INVENTION

1. Objects of the Invention

It is a general object of this invention to advance the state of the art of selectively cosmetically treating hair.

It is another object of this invention to provide an easy-to-perform method for frosting and highlighting hair which enables even the roots of the hair to be treated.

Another object of this invention is to reliably prevent slippage or movement of a hair-treating tool such as a cap, foil sheet, container or the like, relative to the hair being treated.

A further object of this invention is to effectively isolate the hair being treated from hair not to be treated.

Still another object of this invention is to enable viewing of the hair being treated.

Yet another object of this invention is to resist seepage of a treating agent onto hair not to be treated.

2. Features of the Invention

In keeping with these objects, and others which will become apparent hereinafter, one feature of this invention resides, briefly stated, in a hair-treating device which comprises non-slip fastener means for selectively, tightly gripping a bundle or section of hair, and shield means attached to the fastener means. The shield means shields a selected bundle or section of hair different from the hair bundle being gripped. The shield means includes a cover selectively movable from an open position in which the selected hair bundle is exposed for application of a treating agent, to a closed position in which the cover overlies the selected hair bundle and the treating agent applied thereon.

In accordance with this invention, slippage of the device relative to the selected hair bundle being treated is reliably prevented by the non-slip grip on a different hair bundle. The non-slip fastener means advantageously includes a pair of movable jaws, and means for pressing the jaws together. The pressing means may be a discrete, mechanical, locking member slidably mounted on one of the jaws. The locking member successively moves the jaws to and through various positions. In a first so-called slide position, the jaws overlie each other and bound a clearance space through which the jaws are freely slid along the hair bundle being gripped to the scalp. In a final, clamped position, the jaws lock onto the hair bundle closely adjacent the scalp. To insure a close fit, at least one of the jaws has a curved contour conforming to the general curvature of the scalp.

To provide more resistance to accidental shifting, the jaws are provided with raised ribs. In the clamped position, the ribs are interdigitated with one another to form a very secure lock.

The hair-treating device also includes resist means for resisting seepage of the treating agent. The resist means is attached to, and is independently operative of, the fastener means, and preferably includes a bleed-guard mounted for movement on the fastener means to a guard position in which the bleed-guard engages the scalp and seals the shield means.

The aforementioned shield means are preferably constituted of a light-transmissive material so that an operator can view the hair bundle being treated. In a preferred embodiment, the light-transmissive material is a liquid-impermeable, synthetic plastic material and includes a base integral with the cover, the cover being foldable onto the base.

The method of treating hair in accordance with this invention includes the following steps:

A first bundle of hair is placed in a fastener. The fastener is slid along the first bundle of hair to the scalp. The fastener is locked onto the first bundle of hair against the scalp. Thereupon, a shield attached to the fastener is opened. A second bundle of hair different from the first hair bundle is placed into the opened shield. A treating agent is applied to the second bundle of hair in the opened shield. The shield is thereupon closed, and all of the above steps are repeated on successive bundles of hair on the scalp as dictated by the artistic appearance desired. To resist seepage of the treating agent to the scalp and hair not to be treated, the method also includes the step of closing a bleed-guard which engages the scalp and seals the shield means.

The non-slip fastener means in accordance with this invention is continuously adjustable in that it can accommodate both thick and thin individual hair strands. Thus, in a first step, the fastener means only closes a predetermined amount so as to accommodate relatively thick hair strands. In a second step, relatively thinner hair strands are accommodated in the fastener means. Locking is completed onto the hair strands in the final or third step of the mechanical locking action.

Still another feature of the non-slip fastener means of this invention resides in providing a pair of upstanding guides or posts between which the hair bundle to be gripped is confined. This insures that individual hairs will not escape from the fastener means, and that there will be a reliable control over the position of the hair bundle at all times.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
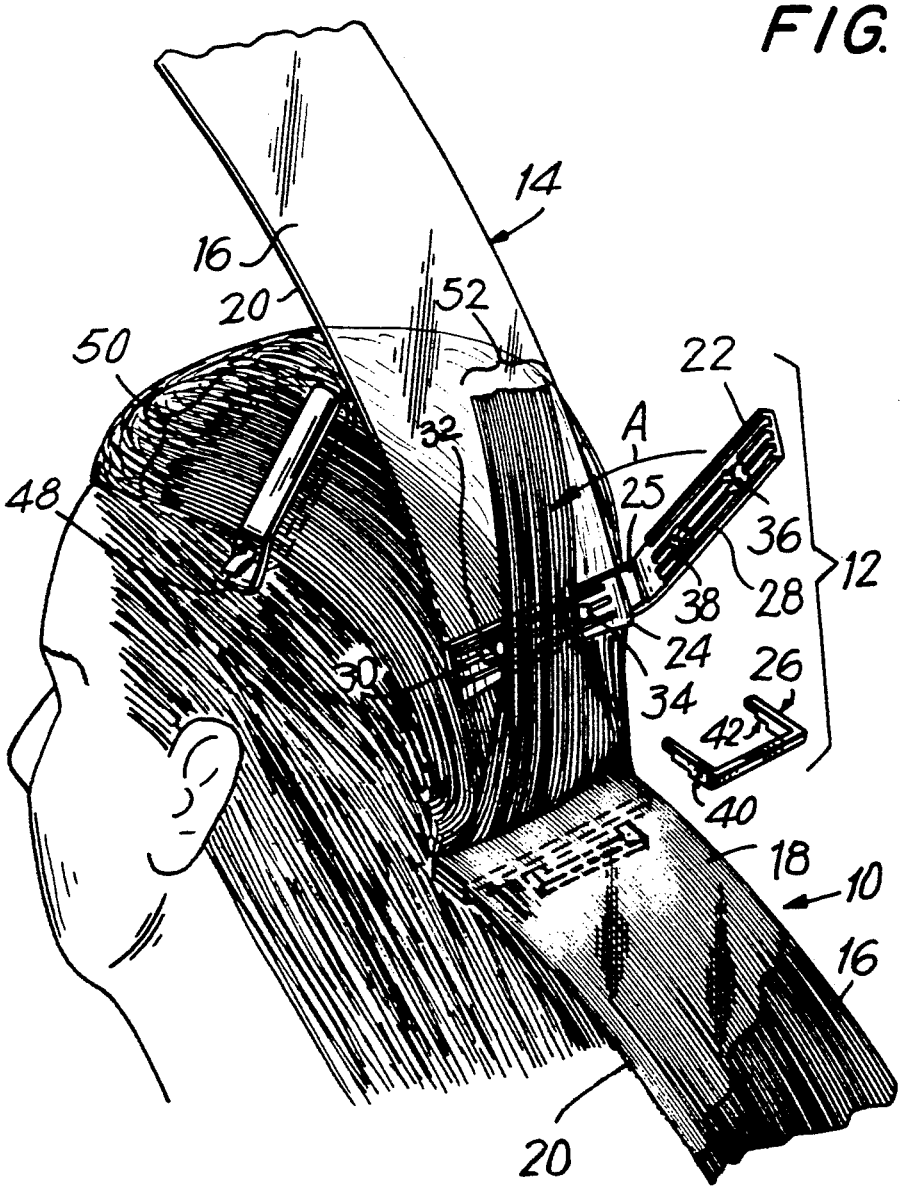
FIG. 1 is a perspective view of a first embodiment of a hair-treating device during positioning on a person's head in accordance with this invention.

Referring now to the drawings, reference numeral 10 in FIGS. 1, 1*a* and 2–5 generally identifies a first embodiment of a hair-treating device or tool. As explained below, a plurality of such devices 10 are arranged on and about a person's hair, typically by an operator, e.g. a beautician, in order to cosmetically treat selected hair bundles or strands to obtain a desired frosted or streaked appearance.

Device 10 includes a non-slip fastener 12 and a shield 14 attached thereto. The shield 14 includes a base 16 and a cover 18 foldable about a fold line 20 onto the base 16. The base and cover are constituted of a single rectangular sheet of light-transmissive, flexible, liquid-impermeable, synthetic plastic material such as polyethylene or polyvinyl chloride. In the preferred embodiment, the shield 14, when the cover 18 is folded over and is commensurate in area with the base 16, measures about $3\frac{1}{4}'' \times 12''$. The base 16 is either heat-fused, adhered with a permanent adhesive, or is otherwise connected, to the fastener 12.

Figure 5:
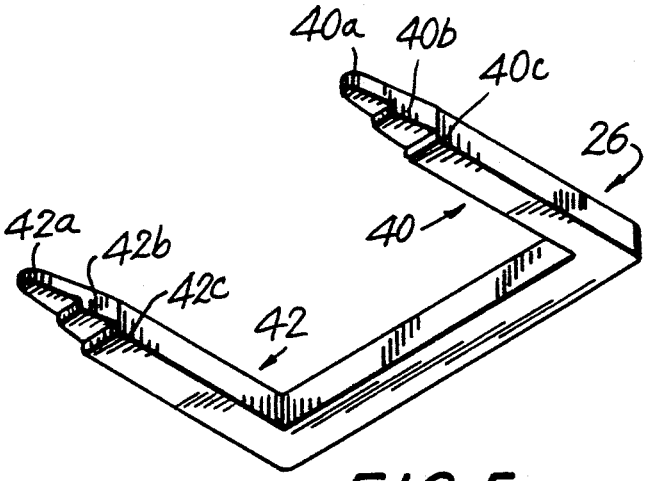
FIG. 5 is a perspective view of a component of the first embodiment.
Figures 6, 7, 8, 9:
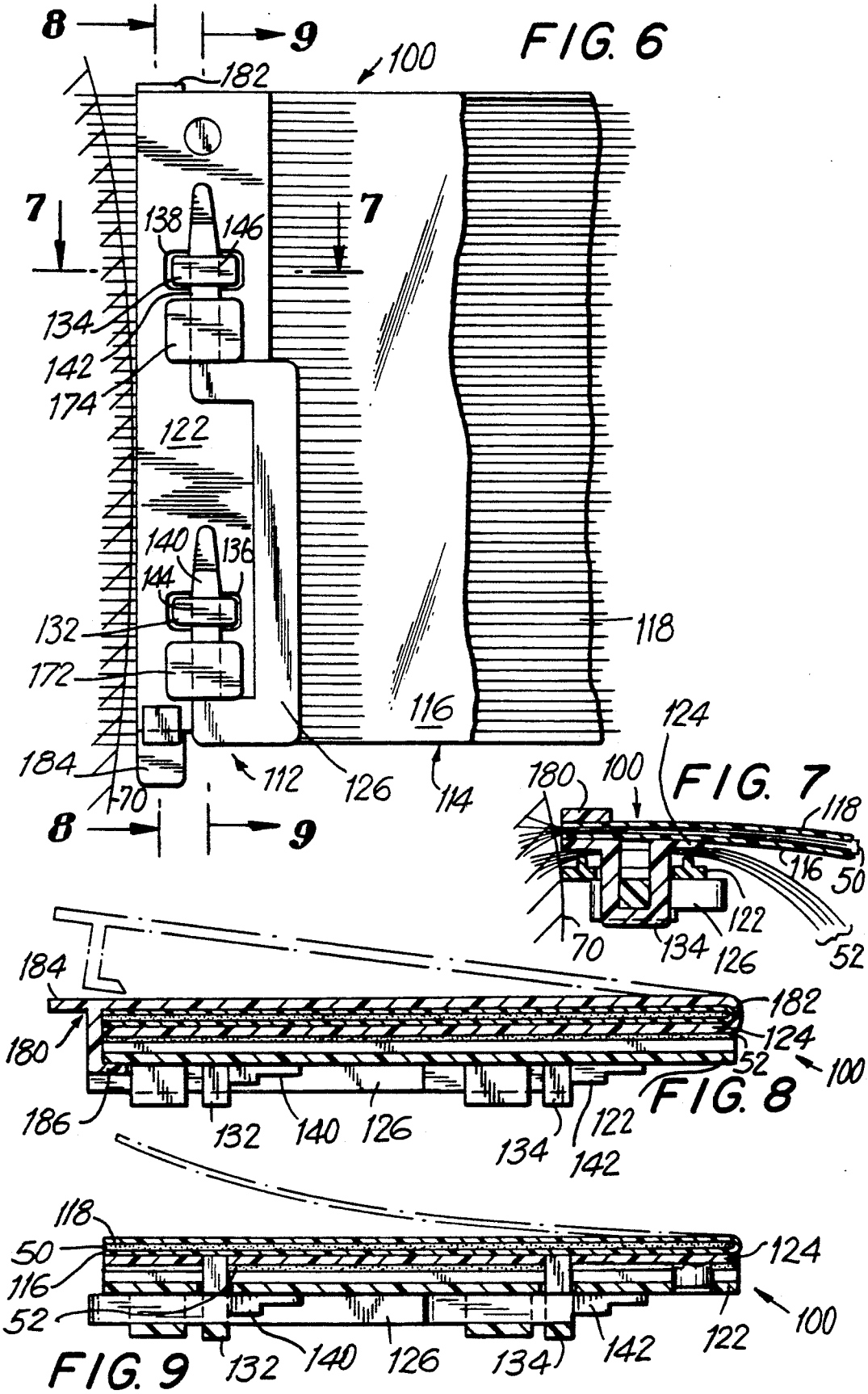
FIG. 6 is a view analogous to FIG. 2, but of a second embodiment of a hair-treating device in accordance with this invention.
FIG. 7 is an enlarged, sectional view taken on line 7—7 of FIG. 6.
FIG. 8 is a sectional view taken on line 8—8 of FIG. 6.
FIG. 9 is a sectional view taken on line 9—9 of FIG. 6.
Figure 10:
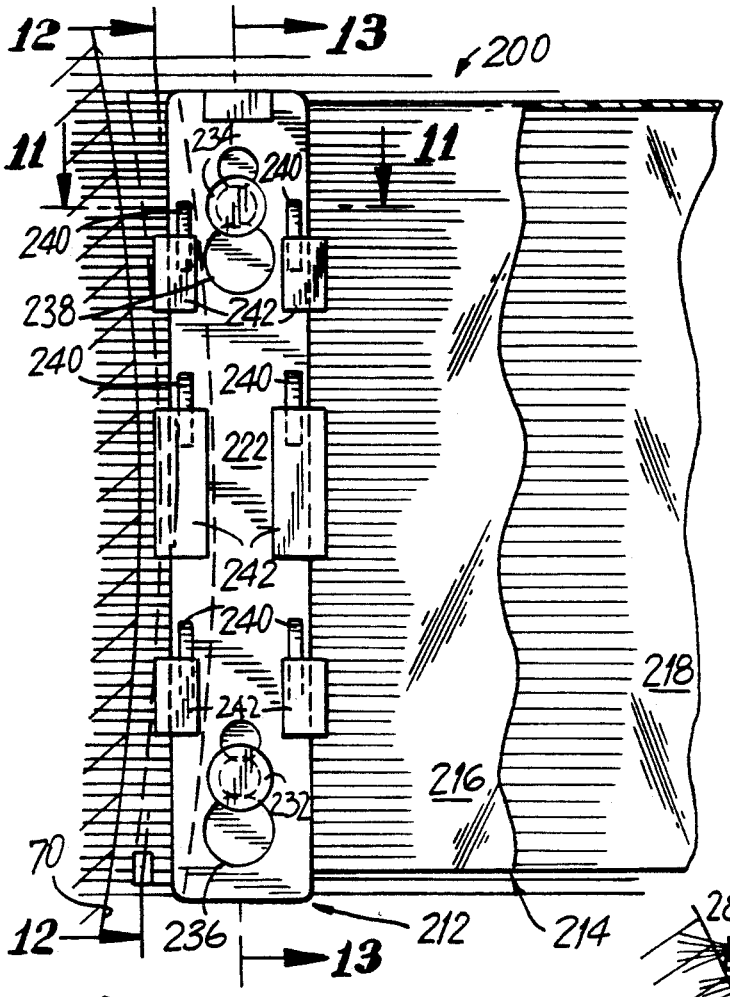
FIG. 10 is a view analogous to FIG. 2, but of a third embodiment of a hair-treating device in accordance with this invention.

The fastener 12 includes a pair of generally planar jaws 22, 24, and a discrete locking member or clamp 26 for clamping the jaws together. All the parts of the fastener are preferably constituted of a molded synthetic plastic material. As shown in FIG. 1, the jaws 22, 24 are hinged together at integral living hinge 25. Two sets 28, 30 of mutually parallel raised ribs are respectively formed on jaws 22, 24. A pair of upstanding posts 32, 34 are formed on jaw 24, while a corresponding pair of apertures 36, 38 are formed in jaw 22. The clamp 26 is generally U-shaped and has two legs 40, 42. As best seen in FIG. 5, each leg 40, 42 is stepped and has ramp-shaped sections 40*a*, 40*b*, 40*c*; 42*a*, 42*b*, 42*c*, respectively. The stepped legs 40, 42 are slidably inserted into passages 44, 46 formed through the posts 32, 34, respectively.

Returning to FIG. 1, the method of this invention includes selecting a first section or bundle 50 of hair to be cosmetically treated, and pinning it out of the way, e.g. by using a conventional spring-biased hair clip 48 or bobbypin. Thereupon, a second section or bundle 52 of hair is selected not for treatment, but to anchor the fastener 12. The bundle 52 is placed within the fastener between the posts 32, 34 of jaw 24. The confinement of the bundle 52 between the posts 32, 34 helps prevent stray hairs from escaping the fastener.

The jaw 22 is pivoted by the operator in the direction of arrow A to overlie the jaw 24. The posts 32, 34 enter and pass through the apertures 36, 38. Next, the clamp 26 is inserted into the passages 44, 46 of the posts 32, 34. The extent to which the clamp 26 is inserted into these passages depends on the thickness of the individual hairs and the quantity of hairs in the bundle 52.

When the leading ramp sections 40*a*, 42*a* are initially inserted into the passages 44, 46, the overlying jaws are spaced apart by a relatively large spacing, typically large enough for even thick individual hairs in a relatively large quantity to be received with clearance. When the intermediate ramp sections 40*b*, 42*b* are inserted into the passages 44, 46, the overlying jaws are brought more closely together. For a large quantity of very thick hairs in the bundle 52, the intermediate sections 40*b*, 42*b* may, in fact, tightly grip and non-slippingly lock onto the bundle 52. If the hairs are thinner and the quantity in the bundle 52 smaller, then the trailing ramp sections 40*c*, 42*c* are available to provide the aforementioned non-slipping, locking action. Put another way, the clamp 26 is a multi-position, continuously-adjustable closure, and is inserted into the passages 44, 46 only to the extent necessary to lock onto the bundle 52. The skilled operator handling the clamp 26 will recognize the tactile feel and detent action upon the transition from one ramp section to another during insertion of the clamp. Of course, the clamp 26 can be provided with one continuous ramp or more than three ramp sections.

Hence, the clamp 26 has a final clamped position and, before reaching that clamped position, has a slide position in which the fastener 12 is slid along the bundle 52 to the person's scalp 70. Only when the fastener 12 reaches the scalp 70 will the clamp 26 be fully inserted and "driven home" to the clamped position. The outer end of at least one jaw, e.g. jaw 24, if not both jaws, is preferably provided with a curved contour complementary to the curvature of the scalp for a closer fit of the fastener to the person's head. In the clamped position, the sets 28, 30 of ribs are interdigitated with one another to provide even more resistance to the fastener being pulled off the bundle 52 caught between the interdigitated ribs.

Figure 1A:
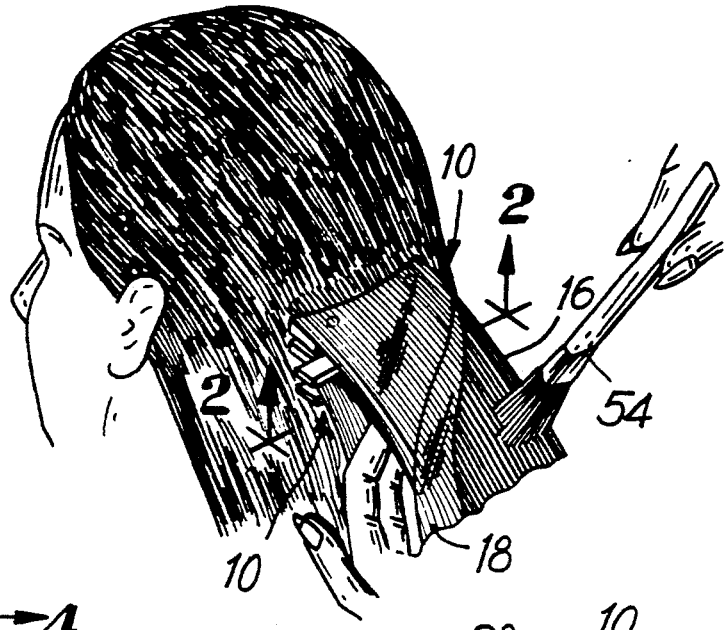
FIG. 1*a* is a view analogous to FIG. 1 at a subsequent stage during which hair is being treated.
Figure 2:
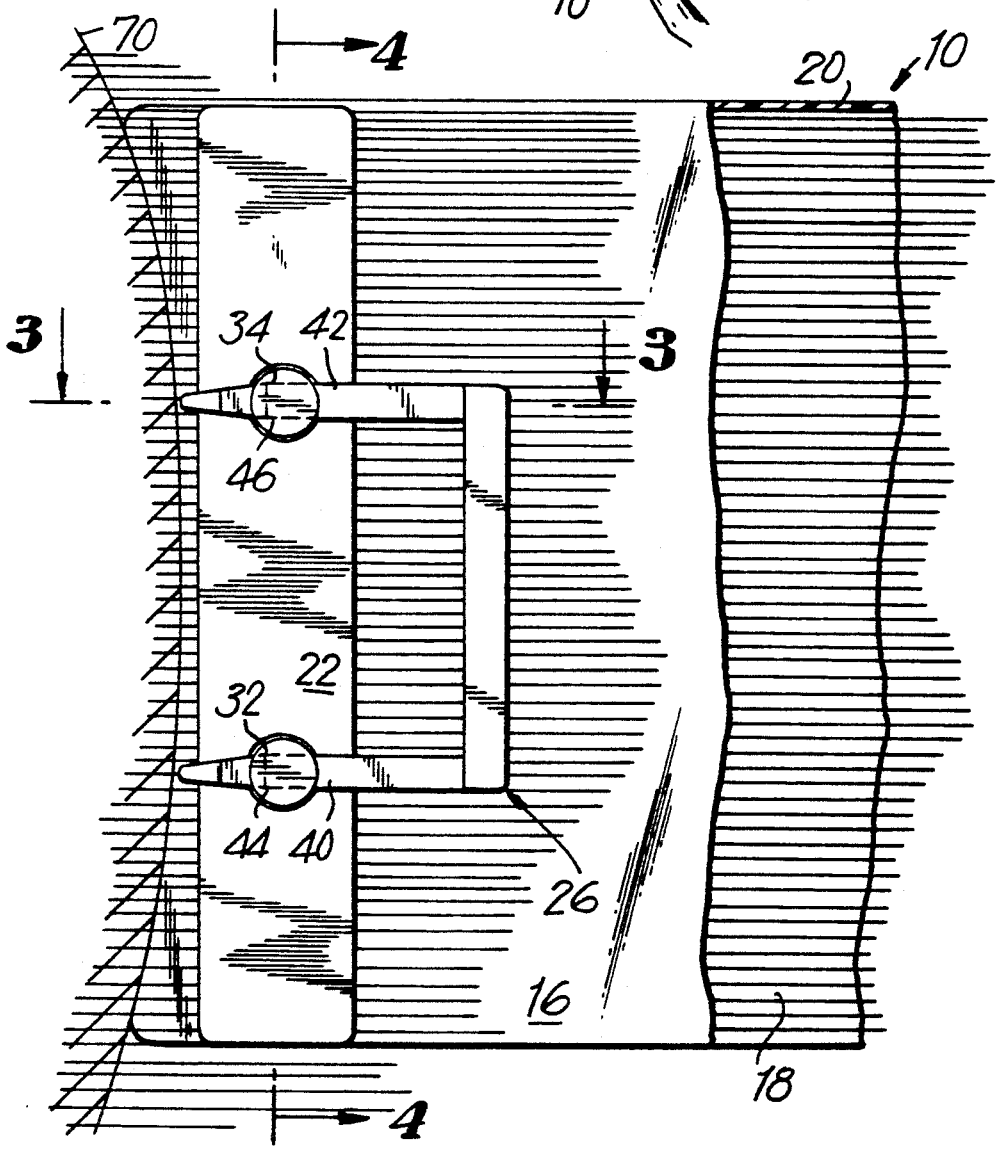
FIG. 2 is an enlarged, sectional view taken on line 2—2 of FIG. 1*a;*
Figure 3:
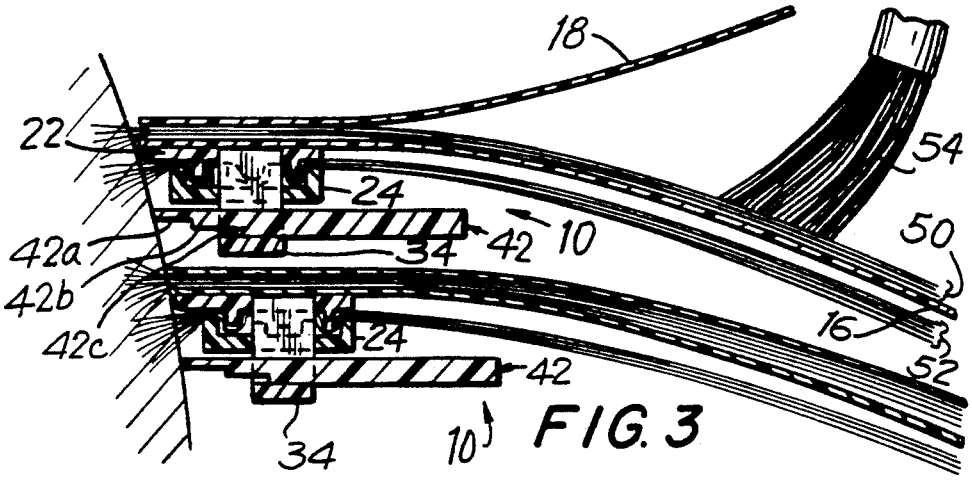
FIG. 3 is an enlarged, sectional view taken on line 3—3 of FIG. 2.
Figure 4:
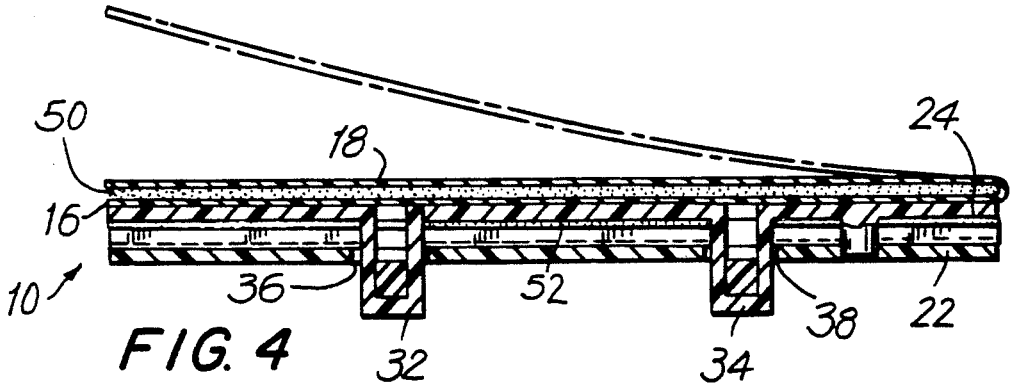
FIG. 4 is a sectional view taken on line 4—4 of FIG. 2.

With the fastener 12 anchored in place on the bundle 52, the shield is lowered from its position overlying the top of the person's head (see FIG. 1) to the position shown in FIG. 1*a*. Thereupon, the cover 18 is unfolded about fold line 20. The bundle 50 is now unclipped by removing the clip 48, and positioned on the base 20 of the opened shield. A hair-treating agent, e.g. a bleach, dye, toner, conditioner or the like, is next applied over the bundle 50 as schematically depicted by brush 54. The treating agent is typically spreadable, e.g. is a liquid, paste, creme or gel, or may even be a spray.

After application of the treating agent, the cover 18 is folded over the bundle 50. The course of the treatment can be inspected by the operator through the light-transmissive cover. The bundle 50 is effectively isolated from the bundle 52 which is not intended to be treated.

The above process is repeated as desired for other hair bundles. FIGS. 1, 1*a* depict only two such devices 10 in an overlying relationship, but it will be readily understood that many more devices 10 can be, and usually are, employed, and the exact number and location of the individual devices depend on the artistic effect to be achieved.

Turning now to FIGS. 6–9, reference numeral 100 generally identifies a second embodiment of a hair-treating device similar to device 10. Device 100 includes a non-slip fastener 112 and a shield 114 attached thereto. The shield 114 has a base 116 and a cover 118. The fastener 112 includes a pair of hinged-together jaws 122, 124 and a locking member or clamp 126. A pair of upright posts 132, 134 are formed on jaw 124, while a corresponding pair of apertures 136, 138 are formed in jaw 122. The clamp 126 has a pair of stepped legs 140, 142 slidably inserted into and through passages 144, 146 formed through the posts 132, 134.

In contrast to the mutually parallel legs 40, 42 of clamp 26, which were inserted in the direction toward the scalp 70 and perpendicularly of the jaws 22, 24, the legs 140, 142 of clamp 126 are in line and are inserted in a direction parallel to the scalp 70 and lengthwise along the jaws 122, 124. A pair of upstanding bosses 172, 174 are formed on the jaw 122, and have internal passages in line with passages 144, 146 to help guide the movement of the clamp 126 to the final clamped position.

Otherwise, the function of the device 100 is like that of device 10. The fastener 112 is initially partially closed on the hair bundle 52 by sliding the clamp 126 partially into the passages in the posts and bosses. The fastener 112 is then slid to the scalp 70, whereupon the clamp 126 is slid as far as possible into the passages in the posts and the bosses, thereby locking the fastener in place on the bundle 52. The shield 114 is thereupon opened; the bundle 50 placed therein and treated; and finally, the shield is closed.

The device 100 also has the added feature of a bleed-guard 180 attached to, and independently operative of, the fastener 112. The guard 180 is hinged to jaw 124 at integral living hinge 182, and is pivoted from an open guard position (phantom lines in FIG. 8) to a closed guard position (solid lines in FIG. 8). The guard 180 has a handle 184 and a latch 186 to engage, with snap action, the jaw 122 in the closed guard position. The guard 180 resists seepage of the treating agent past the open end region of the shield by sealing the cover 118 tightly to the underlying base 116.

FIGS. 10–13 are analogous to FIGS. 6–9, and show a third embodiment of a hair-treating device 200. Device 200 includes a non-slip fastener 212 and a shield 214 attached thereto. The shield 214 has a base 216 and a cover 218. The fastener 212 includes a pair of jaws 222, 224 which are not hinged together as in the previous embodiment. Nor, as previously described, does the device 200 have any separate locking member or clamp. Instead, the jaws 222, 224 slide lengthwise of each other in mutually parallel planes.

A pair of upright posts 232, 234 are formed on jaw 224, while a corresponding pair of apertures 236, 238 are formed in jaw 222. Apertures 236, 238 resemble keyholes, and each aperture has three circular detent-type holes of successively smaller diameters.

Figure 11:
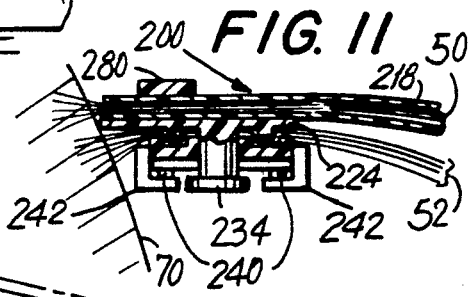
FIG. 11 is an enlarged, sectional view taken on line 11—11 of FIG. 10.
Figure 12:
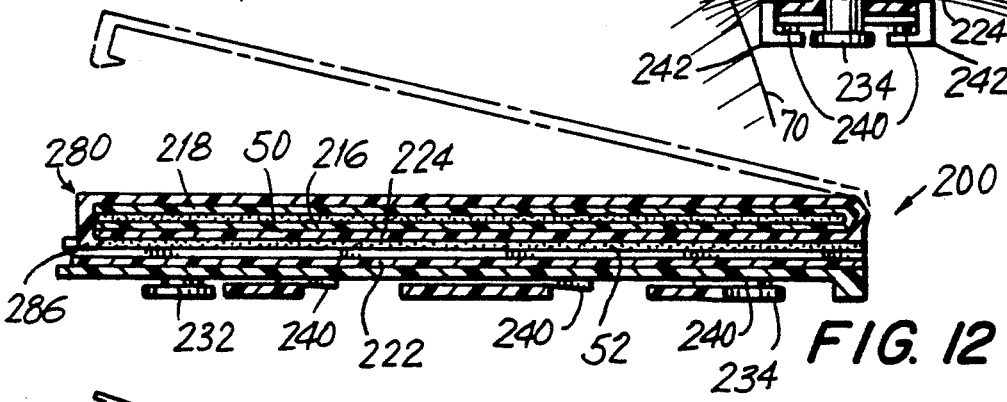
FIG. 12 is a sectional view taken on line 12—12 of FIG. 10.
Figure 13:
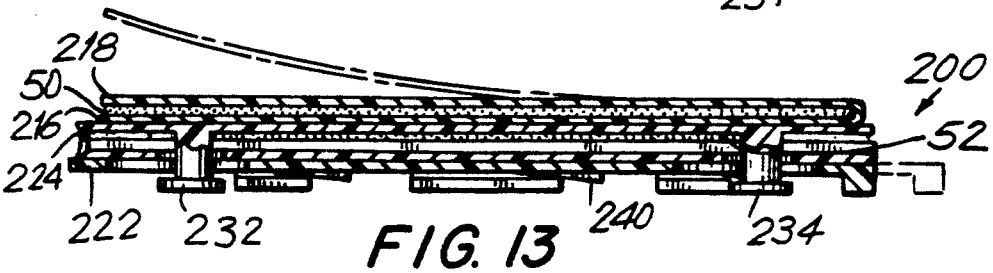
FIG. 13 is a sectional view taken on line 13—13 of FIG. 10.

As best shown in FIG. 11, each upright post has a cylindrical shaft portion received in a respective aperture, and an enlarged outer head. Upon sliding jaw 222 lengthwise relative to jaw 224, the shaft portions of the posts 232, 234 are slid successively from an initial position within the largest circular detent holes of apertures 236, 238, to an intermediate position within the intermediate detent holes of apertures 236, 238, to a final position within the smallest detent holes of apertures 236, 238. The reception of the shafts in a corresponding set of detent holes can be tactilely felt by the operator.

During the aforementioned sliding movement, the jaws 222, 224 are moved toward each other. This is accomplished by providing pairs of ramps 240 integral with, and spaced along, jaw 222, as well as providing corresponding pairs of abutments 242 integral with, and spaced along, the jaw 224. During sliding movement of the jaws, the ramps 240 are driven into deeper wedged engagement underneath the abutments 242, thereby pressing the jaws together.

The three detent positions provided by the detent holes of the apertures 236, 238 tactilely advise the operator whether the fastener is in an initial slide position or a final clamped position.

Device 200, of course, eliminates the need for a discrete clamp. However, the basic step-wise closing of the fastener and the sliding of the fastener toward the scalp prior to a complete closure of the fastener remains the same as previously described. Device 200 also includes a bleed-guard 280 having a latch 286 whose function is identical to that described previously in connection with bleed-guard 180.

Figure 14:
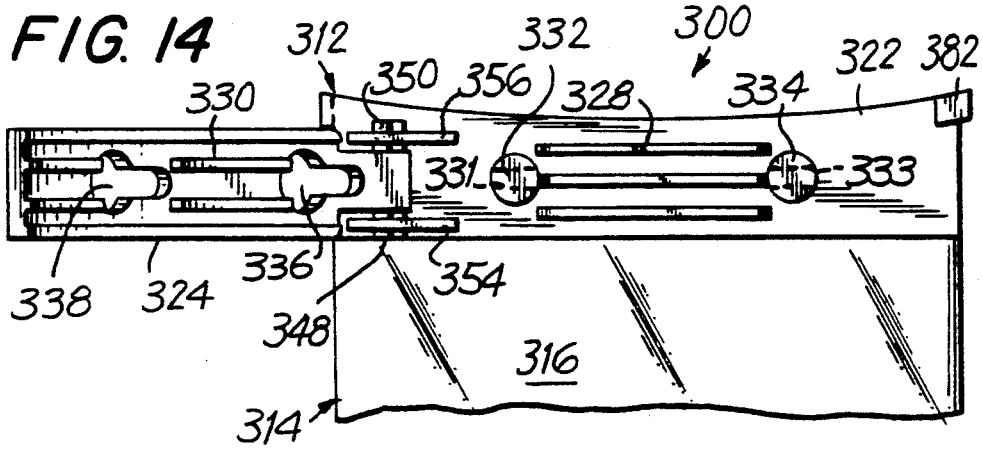
FIG. 14 is a broken-away, top, plan view of a fourth embodiment of a hair-treating device in accordance with this invention.
Figure 15:
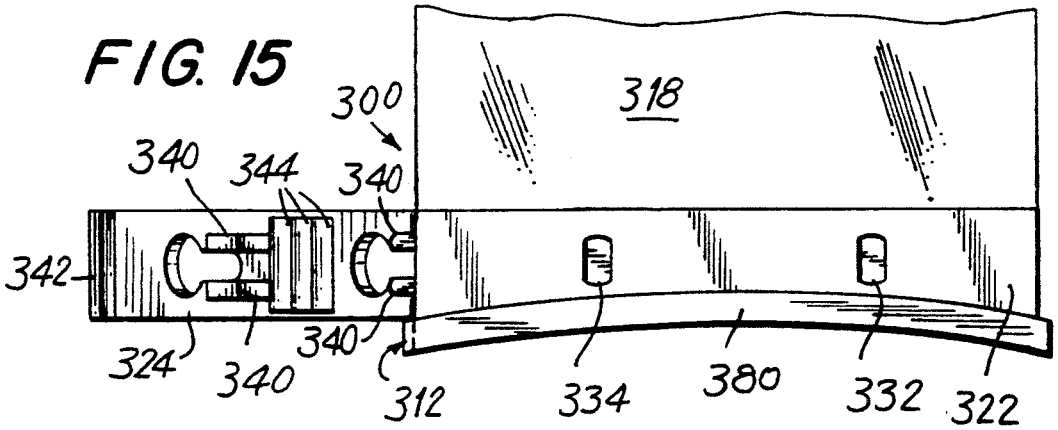
FIG. 15 is a bottom, plan view of the embodiment of FIG. 14.
Figure 16:
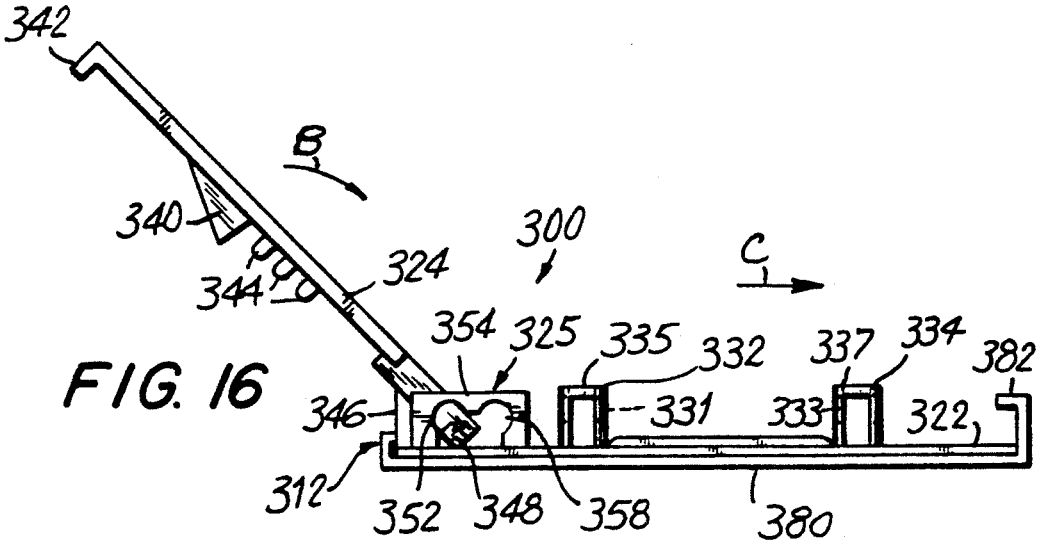
FIG. 16 is a side, elevational view of the embodiment of FIG. 14.

FIGS. 14–16 depict a fourth embodiment of a hair-treating device 300, now envisioned as the most commercially preferred and best mode of this invention. Device 300 includes a non-slip fastener 312, and a shield 314 attached thereto. The shield 314 has a base 316 and a cover 318. The fastener 312 includes a pair of jaws 322, 324 interconnected by a hinge 325 capable of enabling the jaw 324 to pivot and slide lengthwise relative to jaw 322. No separate locking member or clamp is needed for device 300.

A pair of upright posts 332, 334 are formed on jaw 322, while a corresponding pair of keyhole-type apertures 336, 338 are formed in jaw 324. A first set 328 of mutually parallel raised ribs is integrally formed on jaw 322, and a second set 330 of mutually parallel raised ribs is integrally formed on jaw 324. In the closed position of the fastener, the sets 328, 330 interdigitate with each other and capture hair bundle 52 therebetween.

Each keyhole aperture has a first circular hole through which the post is received with clearance, and a second elongated slot in which the post is friction-tightly captured. As best shown in FIG. 16, posts 332, 334 have internal passages 331, 333 bounded by overhead walls or abutments 335, 337. Two pairs of ramps 340 are integrally formed on, and spaced lengthwise along, the jaw 324. Jaw 324 has an outer end formed with a bent flange serving as a handle 342. A set of mutually parallel ridges 344 on the jaw 324 also serve as a handle, as explained below.

A stop 346, best seen in FIG. 16, holds the jaw 324 in an open position at an obtuse angle of about 135° relative to the jaw 322. The jaw 324 has a pair of stub shafts 348, 350 journaled in respective first circular cutouts 352 that are formed in spaced-apart hinge walls 354, 356. The operator grasps the handle 342 and pivots the jaw 324 initially in the direction of arrow B into an overlying relationship with jaw 322. The posts 332, 334 enter and pass through the first circular holes in the keyhole apertures 336, 338. In this partially closed position, the fastener can be slid along the hair bundle 52, as previously described, to the scalp. Jaw 322 has an outer edge of complementary contour to the scalp.

Upon reaching the scalp, the fastener is completely closed. This is accomplished by having the operator grasp the handle ridges 344 and sliding the overlying jaw 324 in the direction of the arrow C lengthwise along jaw 322. During this sliding movement, the stub shafts 348, 350 move out of the first circular cutout 352, and enter respective second circular cutouts 358 also formed in the hinge walls 354, 356. Simultaneously, during this sliding movement, the ramps 340 enter the internal passages 331, 333 of the posts 332, 334 and are urged into wedged engagement with the overhead abutments 335, 337. The overhead abutments 335, 337 push the ramps 340 and, in turn, the jaw 324, downwardly onto the jaw 322, thereby completing the non-slip locking action onto the hair bundle 52.

Independently of the closure action of the fastener 312, a bleed-guard 380 is integrally hinged to the jaw 322, and has a latch 382 for engaging the jaw 324 in the closed position of the fastener 312. The bleed-guard 380 seals the upper marginal regions of the cover 316 and the base 318 to prevent seepage of the treating agent from the shield 314.

As described in all of the above embodiments, the treating agent is applied each time a hair-treating device has been anchored in place and the shield opened. However, in an alternate method of practicing the method of this invention, all of the hair-treating devices are first to be anchored in place and only thereafter, once the devices have been pre-set in position, is the treating agent applied to the hair bundles 50 to be treated.

The fasteners are re-usable over and over again and, hence, the hair-treating devices of this invention can advantageously be used by an individual or by a professional hair dresser without replacement.

It will be understood that each of the elements described above, or two or more together, also may find a useful application in other types of constructions differing from the types described above.

While the invention has been illustrated and described as embodied in a device for and method of cosmetically treating hair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A device for treating hair, comprising:

non-slip fastener means for selectively tightly gripping a first section of hair not to be treated, said fastener means including a pair of elongated movable jaws extending along a longitudinal direction on opposite sides of the first hair section, and means for pressing the jaws together to grip the first hair section therebetween in a transverse direction generally normal to the longitudinal direction, said pressing means including a plurality of locks spaced apart of each other along the longitudinal direction to resist slippage of the fastener means relative to the first hair section; and shield means attached to the fastener means, for shielding a selected second section of hair to be treated, said second hair section being different and remote from the first hair section being gripped, said shield means including a cover selectively movable from an open position in which the selected second hair section is substantially fully exposed for application of a treating agent, to a closed position in which the cover overlies the selected second hair section and the treating agent applied thereon.

2. The device according to claim 1, wherein one of the jaws has upstanding guides spaced apart of each other and bounding therebetween a guide channel for confinedly receiving the first hair section being gripped.

3. The device according to claim 1, wherein the jaws have ribs extending lengthwise of the respective jaws between the locks, and wherein the ribs on one of the jaws face, and are interdigitated with, the ribs on the other of the jaws.

4. The device according to claim 1, wherein the jaws overlie each other and are successively moved by the pressing means to a slide position and a clamped position, said jaws bounding in the slide position a clearance space through which the jaws are slid along the first hair section being gripped to the scalp.

5. The device according to claim 4, wherein the pressing means includes a discrete mechanical locking member slidably mounted on one of the jaws in a direction transverse to the elongation of said one jaw.

6. The device according to claim 5, wherein the locking member has a leading end having a plurality of steps.

7. The device according to claim 4, wherein the pressing means includes a discrete mechanical locking member slidably mounted on one of the jaws in a direction lengthwise of said one jaw.

8. The device according to claim 4, wherein at least one of the jaws has a curved contour conforming to the curvature of the scalp.

9. The device according to claim 1, wherein the jaws are hinged together.

10. The device according to claim 9, wherein the fastener means includes means for holding the jaws in an open position in which the jaws are angularly offset relative to each other.

11. The device according to claim 1, wherein the jaws are slidable along the longitudinal direction.

12. The device according to claim 1, wherein one of the jaws has a handle for manually moving said one jaw.

13. The device according to claim 1; and further comprising resist means attached to, and independently operative of, the fastener means, for resisting seepage of the treating agent.

14. The device according to claim 13, wherein the resist means includes a bleed-guard mounted for movement on the fastener means to a guard position engaging the scalp and sealing the shield means.

15. The device according to claim 1, wherein the shield means includes a base integral with the cover, said shield means having a fold line about which the cover is foldable onto the base.

16. The device according to claim 15, wherein the cover and the base are constituted of a light-transmissive material.

17. A method of treating hair, comprising the steps of:

(a) placing a first section of hair in a fastener;

(b) sliding the fastener along the first section of hair to the scalp;

(c) locking the fastener onto the first section of hair against the scalp;

(d) opening a shield attached to the fastener;

(e) placing a second section of hair, different from the first hair section, into the opened shield; and (f) closing the shield.

18. The method according to claim 17, wherein steps (a)-(f) are repeated for successive fasteners, shields and sections of hair on the scalp.

19. The method according to claim 18; and further comprising the step of applying a treating agent to each second section of hair after all the fasteners have been locked on each first bundle of hair.

20. The method according to claim 17; and further comprising the step of applying a treating agent to the second section of hair before closing the shield.

21. The method according to claim 20; and further comprising the step of closing a bleed-guard to resist seepage of the treating agent to the scalp.

* * * * *